US006052857A

United States Patent [19]

Donahue

[11] Patent Number: 6,052,857

[45] Date of Patent: Apr. 25, 2000

[54] FLEXIBLE TROWEL

[76] Inventor: Raymond William Donahue, 800 Ben Franklin Rd., North Indiana, Pa. 15701

[21] Appl. No.: 09/054,818

[22] Filed: Apr. 3, 1998

[51] Int. Cl.[7] ..... B05C 17/10

[52] U.S. Cl. ..... 15/235.4; 15/143.1; 15/144.1

[58] Field of Search ..... 15/236.01, 235.4, 15/235.8, 235.7, 235.6, 235.5, 144.1, 144.2, 143.1, 236.02, 236.04, 236.08, 236.09; 294/53.5, 57; 425/458

[56] References Cited

U.S. PATENT DOCUMENTS

| | | | |
|---|---|---|---|
| D. 343,998 | 2/1994 | Griggs . | |
| 842,770 | 1/1907 | Connelly | 15/144.2 |
| 2,834,199 | 5/1958 | Freeman | 15/235.8 |
| 2,980,457 | 4/1961 | Page | 15/245 |
| 3,090,066 | 5/1963 | Ferrell, Jr. et al. | 15/235.8 |
| 3,146,481 | 9/1964 | Chiuchiarelli | 15/235.8 |
| 4,520,527 | 6/1985 | Maggio et al. | 15/144.2 |
| 4,753,471 | 6/1988 | Gringer . | |
| 4,856,932 | 8/1989 | Kraft . | |
| 5,103,520 | 4/1992 | Mazzo . | |
| 5,115,536 | 5/1992 | Jarvis . | |
| 5,406,671 | 4/1995 | Green . | |
| 5,836,040 | 11/1998 | Giacomelli | 15/235.8 |

FOREIGN PATENT DOCUMENTS

| | | |
|---|---|---|
| 971200 | 9/1964 | United Kingdom . |

*Primary Examiner*—Robert J. Warden, Sr.
*Assistant Examiner*—Kaj K. Olsen
*Attorney, Agent, or Firm*—Richard V. Westerhoff; Eckert Seamans Cherin & Mellott, LLC

[57] ABSTRACT

A flexible trowel has a compliant coupling between the handle and the blade. In the preferred embodiment, the handle is pivotally mounted to the elongated shaft extending from the planar blade for rotation in a plane generally perpendicular to the blade. The pivot pin extends transversely through a longitudinal recess in the handle. The handle is biased upward by a helical compression spring seated in a transverse passage in the handle and adjustably preloaded by a follower nut threaded on a bolt axially restrained in the end of the transverse passage by a retainer cap.

12 Claims, 2 Drawing Sheets

FLEXIBLE TROWEL

BACKGROUND OF THE INVENTION

1. Field of the Invention

This invention relates to a hand tool, and in particular, a trowel for laying, spreading and finishing mortar and cement or other spreadable materials wherein the blade and handle are compliantly moveable relative to each other.

2. Background Information

Trowels are well known hand tools used, for instance, for laying, spreading and finishing spreadable materials such as mortar or concrete. Traditionally, the trowel includes a flat metal blade with an integral elongated shaft to which a handle is fixed. While the blade being a thin metal member usually has some compliance, at least near its free end, the structure is rigid, with the handle and shaft unyieldingly fixed to each other.

In applying mortar or concrete with a trowel, the material must be "set" on the blade. That is, the mortar or cement must be made to adhere to a degree to the blade so that the blade may be tilted, even vertically, to apply the material to the desired surface. Typically, the material is set on the blade by holding the trowel with the blade horizontal and snapping the wrist to produce separation between the blade and the material which then falls onto the blade to provide the set. Prolonged use of a trowel in this manner is tiring and places a strain on the user's wrist. It should also be noted that with extended use, the blade of the trowel wears and becomes smaller thereby affecting the amount of material that can be loaded onto the blade. Also, the different types and even mixtures of a particular type of spreadable material, including its water content, affect the loading on the blade.

There is a need therefore for an improved trowel.

More particularly there is a need for a trowel which can be used for a prolonged period of time with reduced fatigue for the user.

Specifically, there is a need for a trowel which reduces the impact loading on the wrist of the user.

There is a further need for such an improved trowel which can accommodate for a user's preference as to the feel of the impact loading.

There is an additional need for such an improved trowel which can accommodate for wear of the blade and for variations in the specific weight of the material being spread by the trowel.

SUMMARY OF THE INVENTION

These needs and others are satisfied by the invention which is directed to a trowel having a trowel member with a generally planar blade and an elongated shaft extending from the blade, and a handle mounted on the shaft. The handle is compliantly moveable relative to the planar blade generally in a plane perpendicular to the planar blade. Preferably, the handle includes a handle body and mounting means compliantly mounting the handle body to the elongated shaft. This mounting means also includes means for adjusting the compliance of the movement of the handle relative to the planar blade. The mounting means for the handle includes biasing means in the form of a spring which biases the handle upward relative to the upper surface of the planar blade. Preferably, the spring is a helical compression spring with adjusting means for adjusting the preload on the spring to accommodate for individual preference, variations in the specific weight of materials being troweled and wear on the blade.

In the most preferred embodiment of the invention, a pivot member pivotally mounts the handle body on the elongated shaft and the spring biases the handle upward about the pivot member. In the disclosed embodiment, the handle body has a longitudinal recess in which the pivot member pivotally mounts the handle to the shaft. In this embodiment, the helical compression spring is mounted generally in the plane perpendicular to the blade and generally perpendicular to the elongated shaft to bias the handle about the elongated shaft in the upward direction. The preferred means for adjusting the preload on the spring includes a threaded member, a support member aligning the threaded member with the spring for rotation without axial movement, a follower nut bearing against the spring and engaging the threaded member, and means restraining rotation of the follower nut so that the follower nut moves axially on the threaded member to adjust the preload on the spring as the threaded member is rotated. The means restraining rotation is preferably one or more radial projections on the follower nut which engage axial slots in a passage in the handle body transverse to the elongated shaft in which the spring is mounted.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
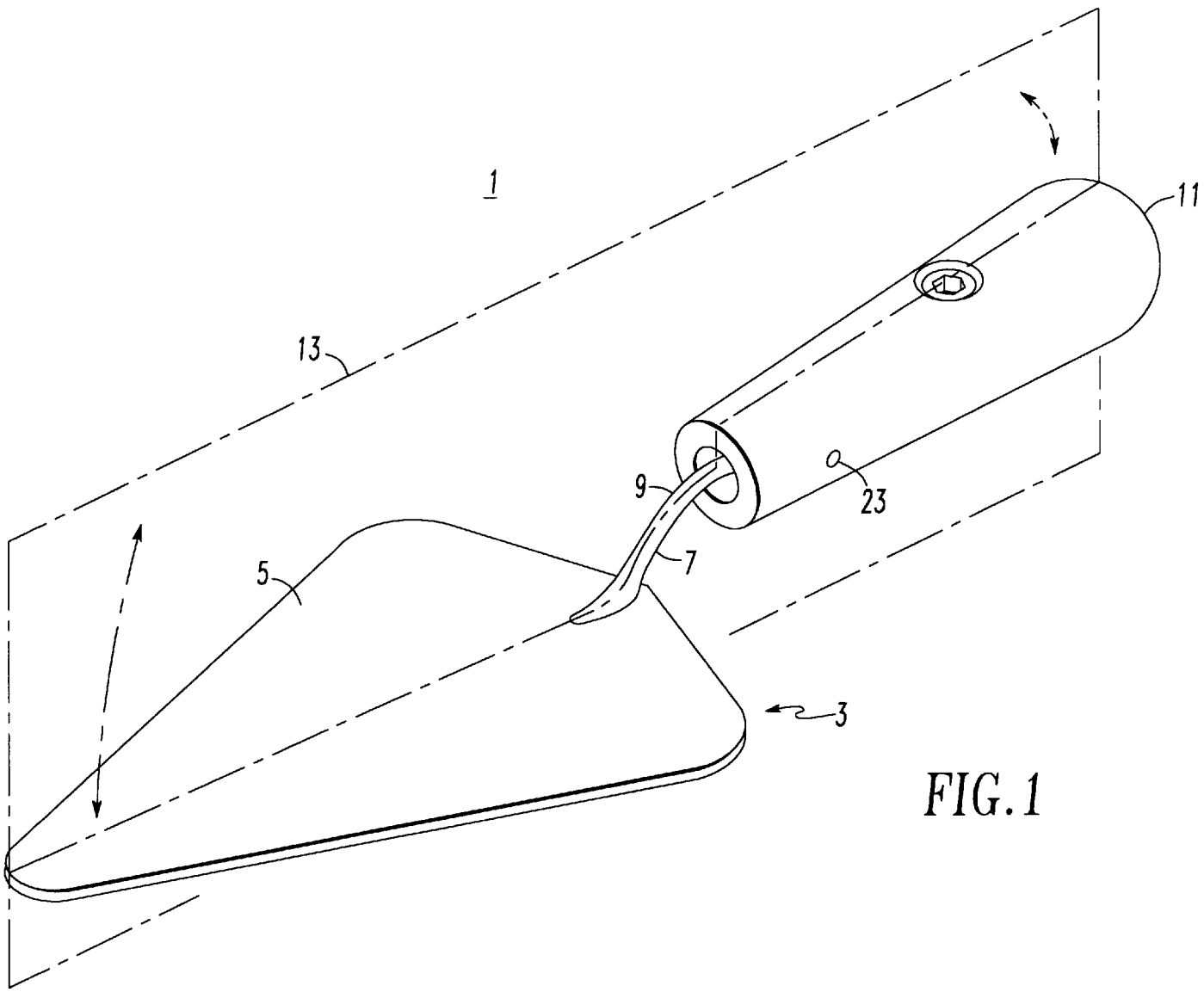
FIG. 1 is an isometric view of a trowel in accordance with the invention.

Referring to the drawings, the flexible trowel 1 of the invention includes a trowel member 3 having a planar blade 5 and an integral elongated shaft 7 extending from one end of the blade. The shaft can have an offset 9. A handle 11 is mounted on the free end of the elongated shaft 7. Up to now, the handle has been unyieldingly secured to the elongated shaft 7 so that the trowel is rigid and there is no relative movement between the planar blade 5 and the handle 11.

Figure 2:
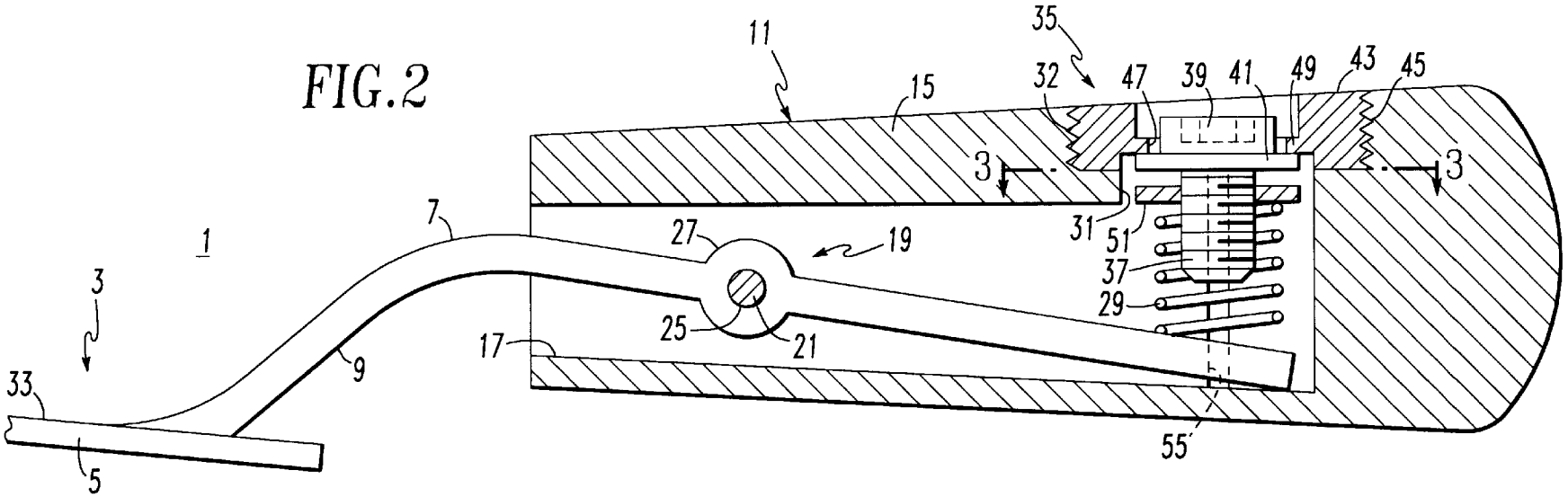
FIG. 2 is a longitudinal section through the handle end of the trowel of FIG. 1.
Figure 3:
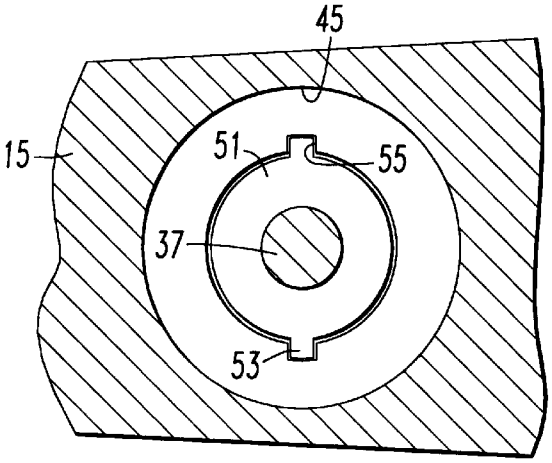
FIG. 3 is a fragmentary horizontal section taken along the line 3—3 in FIG. 2.

In accordance with the invention, the handle 11 is compliantly moveable relative to the planar blade in a plane 13 which is generally perpendicular to the planar blade. In the preferred embodiment of the invention, compliance is provided between the handle 11 and the elongated shaft 7. As best seen in FIG. 2, the handle 11 includes an elongated handle body 15 having a longitudinal recess 17 extending inward from one end and a mounting arrangement 19 for mounting the handle body 15 on the elongated shaft 7. This mounting arrangement 19 includes a pivot member 21 extending across the recess 17 for pivotally mounting the handle body 15 on the elongated shaft 7. This pivot member 21 can be a pin extending through apertures 23 (see FIG. 1) in the handle and an aperture 25 in a boss 27 formed on the elongated shaft 7. A biasing member in the form of a helical compression spring 29 is seated in a passage 31 in the handle body which is generally perpendicular to the longitudinal recess 17. One end of the helical compression spring 29 bears against the side of the elongated shaft 7 to bias the handle body 15 upward relative to the upper surface 33 of the planar blade 5.

An adjustment assembly 35 permits the preload on the helical compression spring 29 to be varied to meet individual preferences and to accommodate for wear on the blade (which means that it can support less material) and for variations in the specific weight of the material being troweled. This adjustment assembly 35 includes a threaded member such as a bolt 37. The head 39 of the bolt 37 has an annular flange 41. A support member in the form of a retainer cap 43 with external threads 45 is threaded into a tapped counterbore 32 of the passage 31 and has a central opening 47 through which the head 39 of the bolt 37 projects. This opening 47 is counterbored from the underside to form a shoulder 49 against which the flange 41 on the bolt 37 seats.

The adjustment assembly 35 also includes a follower nut 51 which is threaded onto the threaded member or bolt 37 and bears against the upper end of the helical compression spring 29. Rotation of the follower nut 51 is restrained by a pair of diametrically opposed radial projections 53 which engage and slide along axially extending slots 55 in the walls of the passage 31. As the follower nut 51 is restrained from rotation, rotation of the bolt 37 causes the follower nut to move along the bolt thereby adjusting the preload on the helical compression spring 29.

In use, the helical compression spring compliantly yields to the shock generated when the material is set against the blade. The compliance can be adjusted with the adjusting bolt 37, for the purposes discussed above. As shown, an Allen head bolt is used, however, other types can be used. For instance, a bolt with a wing head would eliminate the need for a tool to adjust the preload on the spring. This compliant mounting of the handle also reduces the shock when the blade is loaded with material such as when the blade is stabbed into the material and lifted up.

While a specific embodiment of the invention has been described in detail, it will be appreciated by those skilled in the art that various modifications and alternatives to this detail could be developed in light of the overall teachings of the disclosure. For instance, the compliance between the handle 11 and blade 5 could be provided by a flexible shaft 7. Such compliance can be provided in the shaft by flattening the shaft at the point where the flexibility is desired. Accordingly, the particular arrangements disclosed are meant to be illustrative only and not limiting as to the scope of invention which is to be given the full breath of the claims appended and any and all equivalents thereof.

What is claimed is:

1. A flexible trowel comprising:

a trowel member having a generally planar blade and an elongated shaft extending from said blade, and a handle comprising a handle body and a mounting means compliantly mounting said handle body to said elongated shaft for compliant movement relative to said planar blade generally in a plane perpendicular to said planar blade, and wherein said blade has an upper surface and said mounting means comprises biasing means biasing said handle body upward relative to said upper surface of said planar blade generally in said plane perpendicular to said planar blade.

2. The flexible trowel of claim 1 wherein said biasing means comprises a spring.

3. The flexible trowel of claim 2 wherein said mounting means further includes means adjusting preload on said spring.

4. The flexible trowel of claim 1 wherein said mounting means further includes a pivot member pivotally mounting said handle body on said elongated shaft, said biasing means biasing said handle upward about said pivot member.

5. The flexible trowel of claim 4 wherein said biasing means comprises a spring.

6. The flexible trowel of claim 5 wherein said mounting means further includes adjusting means for adjusting preload on said spring.

7. . The flexible trowel of claim 5 wherein said spring comprises a helical compression spring.

8. The flexible trowel of claim 7 wherein said handle body has a longitudinal recess in which said pivot member pivotally mounts the handle body to said elongated shaft, and wherein said mounting means includes spring mounting means mounting said helical compression spring to said handle body to bear against said elongated shaft and pivot said handle body upward about said pivot member.

9. The flexible trowel of claim 8 wherein said mounting means comprises adjusting means for adjusting preload on said helical compression spring.

10. The flexible trowel of claim 9 wherein said adjusting means comprises a threaded member, a support member aligning said threaded member with said helical compression spring for rotation without axial movement, a follower nut bearing against said helical compression spring and engaging said threaded member, and means restraining rotation of said follower nut so that said follower nut moves axially on said threaded member to adjust said preload on said helical compression spring as said threaded member is rotated.

11. The flexible trowel of claim 10 wherein said handle body has a passage generally transverse to said longitudinal recess in which said helical compression spring is mounted, and wherein said restraining means comprises at least one radial projection on said follower nut and at least one axial slot in said passage in said handle body engaged by said at least one radial projection.

12. A flexible trowel comprising:

a trowel member having a generally planar blade and an elongated shaft extending from said blade; and a handle comprising a handle body and a mounting means compliantly mounting said handle body to said elongated shaft for compliant movement relative to said planar blade generally in a plane perpendicular to said planar blade, and wherein said mounting means includes means for adjusting compliance of said compliant movement of said handle body relative to said planar blade.

* * * * *